US007717322B2

(12) United States Patent
Walsh et al.

(10) Patent No.: US 7,717,322 B2
(45) Date of Patent: May 18, 2010

(54) PACKAGES, BLANKS FOR MAKING PACKAGES AND ASSOCIATED METHODS

(75) Inventors: Joseph C. Walsh, Boulder, CO (US); Robert L. Conatser, Golden, CO (US); Raymond S. Kastanek, Longmont, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 11/951,633

(22) Filed: Dec. 6, 2007

(65) Prior Publication Data

US 2008/0116250 A1 May 22, 2008

Related U.S. Application Data

(63) Continuation of application No. PCT/US2006/022560, filed on Jun. 8, 2006.

(60) Provisional application No. 60/688,505, filed on Jun. 8, 2005, provisional application No. 60/724,537, filed on Oct. 7, 2005.

(51) Int. Cl.
*B65D 43/16* (2006.01)

(52) U.S. Cl. ..... 229/125.01; 229/217; 220/259.4

(58) Field of Classification Search ..... 229/215, 229/217, 125.05, 125.12, 131.1, 125.11; 40/124.06, 488, 491; 220/256.1, 259.1, 259.2, 220/254.4, 259.4, 253; 221/305; 222/92, 222/97, 104, 480, 557
See application file for complete search history.

(56) References Cited

U.S. PATENT DOCUMENTS 1,145,668 A 7/1915 Brown
1,478,791 A * 12/1923 Nelson ..... 40/491
1,762,703 A 6/1930 Smith
1,844,952 A * 2/1932 Freedman et al. ..... 222/480
1,869,751 A * 8/1932 Lacobitti ..... 229/220
1,911,215 A 5/1933 Walter
2,005,924 A 6/1935 Wilson
2,006,203 A 6/1935 Leslie
2,098,818 A 11/1937 Andrews
2,343,222 A 2/1944 Nelson
2,346,134 A * 4/1944 Kirkland et al. ..... 222/557
2,348,377 A 5/1944 Goodyear
2,407,781 A 9/1946 Guyer
2,502,117 A 3/1950 Anderson
2,576,594 A 11/1951 Goldstein
2,701,679 A 2/1955 Goldstein
2,706,076 A 4/1955 Guyer
2,775,393 A 12/1956 Rugg
2,778,557 A 1/1957 Moore
2,848,151 A 8/1958 O'Neil
2,934,251 A 4/1960 Kramer
2,944,726 A 7/1960 McCauley (Continued)

FOREIGN PATENT DOCUMENTS

DE 1091851 10/1960

(Continued)

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

Cartons are formed from two or more continuous webs that can individually or concurrently provided with cuts, scores, or other lines of disruption.

15 Claims, 8 Drawing Sheets

U.S. PATENT DOCUMENTS 2,993,632 A 7/1961 De Feo
3,048,324 A 8/1962 Anderson
3,116,866 A 1/1964 Boran
3,137,437 A 6/1964 Svensson
3,159,326 A 12/1964 Stonebanks
3,184,136 A 5/1965 Forbes, Jr.
3,414,182 A 12/1968 Fobiano
3,417,911 A 12/1968 Hennessey
3,640,447 A 2/1972 Forbes, Jr. et al.
3,768,719 A 10/1973 Johnson
3,831,836 A 8/1974 Ellison et al.
3,891,137 A 6/1975 Ellison et al.
3,905,646 A 9/1975 Brackmann et al.
3,951,333 A 4/1976 Forbes, Jr. et al.
3,981,430 A 9/1976 Keim
4,015,768 A 4/1977 McLennan
4,027,794 A 6/1977 Olson
4,046,307 A 9/1977 Booth et al.
4,095,735 A 6/1978 Stone
4,141,485 A * 2/1979 Lambert ..... 229/220
4,165,030 A 8/1979 Bunger et al.
4,168,003 A * 9/1979 Wysocki ..... 229/217
4,194,677 A 3/1980 Wysocki
4,308,956 A * 1/1982 Steinke et al. ..... 229/234
4,341,338 A 7/1982 Arnold
4,345,393 A * 8/1982 Price et al. ..... 40/312
4,371,109 A 2/1983 Tanner et al.
4,458,810 A 7/1984 Mahoney
4,548,318 A 10/1985 Boyle
4,608,038 A 8/1986 Virta et al.
4,768,703 A 9/1988 Sosler et al.
4,781,317 A 11/1988 Ditto
4,909,395 A 3/1990 Weissman
4,913,292 A 4/1990 Field
4,946,540 A 8/1990 Mitchard
4,948,033 A 8/1990 Halsell, II et al.
4,989,735 A 2/1991 O'Brien
5,012,959 A 5/1991 Gordon
5,050,742 A 9/1991 Muckenfuhs
5,069,359 A 12/1991 Liebel
5,071,010 A 12/1991 Carufel/Zeman
5,083,667 A 1/1992 Holder
5,092,516 A 3/1992 Kastanek
5,125,568 A 6/1992 Bauer
5,129,875 A 7/1992 Chaygneaud-Dupuy
5,141,150 A 8/1992 Plaessmann
5,222,660 A 6/1993 Koss
5,238,181 A 8/1993 Mahler
5,251,808 A 10/1993 Rudd
5,285,956 A 2/1994 Piepho
5,328,091 A 7/1994 Koss
5,373,960 A 12/1994 Gunn et al.
5,429,297 A 7/1995 Walsh
5,450,680 A 9/1995 Bromberg
5,544,806 A 8/1996 Anderson et al.
5,551,938 A 9/1996 Stone
5,584,430 A 12/1996 Mulry
5,588,585 A 12/1996 McClure
5,599,267 A 2/1997 Dupuy
5,601,521 A 2/1997 Plamas Xapelli
5,632,404 A 5/1997 Walsh
5,678,755 A * 10/1997 Block ..... 229/215
5,757,930 A 5/1998 Seidemann et al.
5,775,576 A 7/1998 Stone
5,794,811 A 8/1998 Walsh
5,810,250 A 9/1998 Stone et al.
5,826,783 A 10/1998 Stout
5,857,614 A 1/1999 Walsh
5,893,513 A 4/1999 Stone et al.
5,967,374 A 10/1999 Baker
6,015,084 A 1/2000 Mathieu et al.
6,027,018 A * 2/2000 Yocum ..... 229/400
6,059,182 A 5/2000 Wein
6,110,095 A 8/2000 Finke et al.
6,131,729 A 10/2000 Eckermann et al.
6,145,736 A 11/2000 Ours et al.
6,158,653 A 12/2000 Kanter et al.
6,189,777 B1 2/2001 Hutchinson et al.
6,221,192 B1 4/2001 Walsh
6,230,881 B1 5/2001 Collura
6,332,488 B1 12/2001 Walsh
6,435,402 B1 * 8/2002 Hengami ..... 229/120.03
6,631,803 B2 10/2003 Rhodes et al.
6,689,034 B2 2/2004 Walsh
6,889,892 B2 * 5/2005 Walsh et al. ..... 229/117.31
6,948,293 B1 9/2005 Eckermann et al.
2001/0048022 A1 12/2001 Zoeckler
2002/0055429 A1 5/2002 Walsh
2002/0060240 A1 5/2002 Walsh
2005/0103681 A1 5/2005 Aubry et al.

FOREIGN PATENT DOCUMENTS

DE 89 08 393 U1 9/1989
EP 0 079 155 A2 5/1983
EP 0 542 449 A1 5/1993
FR 2 686 316 7/1993
GB 2 275 913 A 9/1994
GB 2 379 923 A 3/2003
JP 44-25911 10/1969
WO WO 92/01606 A1 2/1992
WO WO 97/27114 7/1997
WO WO 02/11516 A1 2/2002
WO WO 03/051622 A 6/2003

* cited by examiner

PACKAGES, BLANKS FOR MAKING PACKAGES AND ASSOCIATED METHODS

RELATED APPLICATIONS

This application is a continuation of Application No. PCT/US06/022560, filed Jun. 8, 2006, which designates the United States and claims the benefit of U.S. Provisional Application No. 60/688,505, filed Jun. 8, 2005 and U.S. Provisional Application No. 60/724,537, filed Oct. 7, 2005, the specifications and drawings of all of the aforesaid applications being hereby incorporated by reference.

This application is related to application Ser. No. 10/318,437, filed Dec. 13, 2002, the entire contents of which are hereby incorporated by reference.

BACKGROUND

Conventional cartons may include features such as closure devices, lids, and other convenient features. Features of a certain complexity, however, may require the carton blank to be prepared in a batch process, where features or articles can be individually cut and/or glued to the carton blank. Batch processing is slow when compared to continuous processes, and may involve higher costs.

SUMMARY

According to a first exemplary aspect of the invention, a carton is formed from an inner blank joined to an outer blank. The carton includes a rotatable dispenser panel that allows product to be selectively dispensed from the carton.

According to a second exemplary aspect of the invention, a carton is formed from an inner blank joined to an outer blank. The carton includes a display feature that allows an extension panel of the outer blank to be moved away from a remainder of the carton into a highly visible position.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
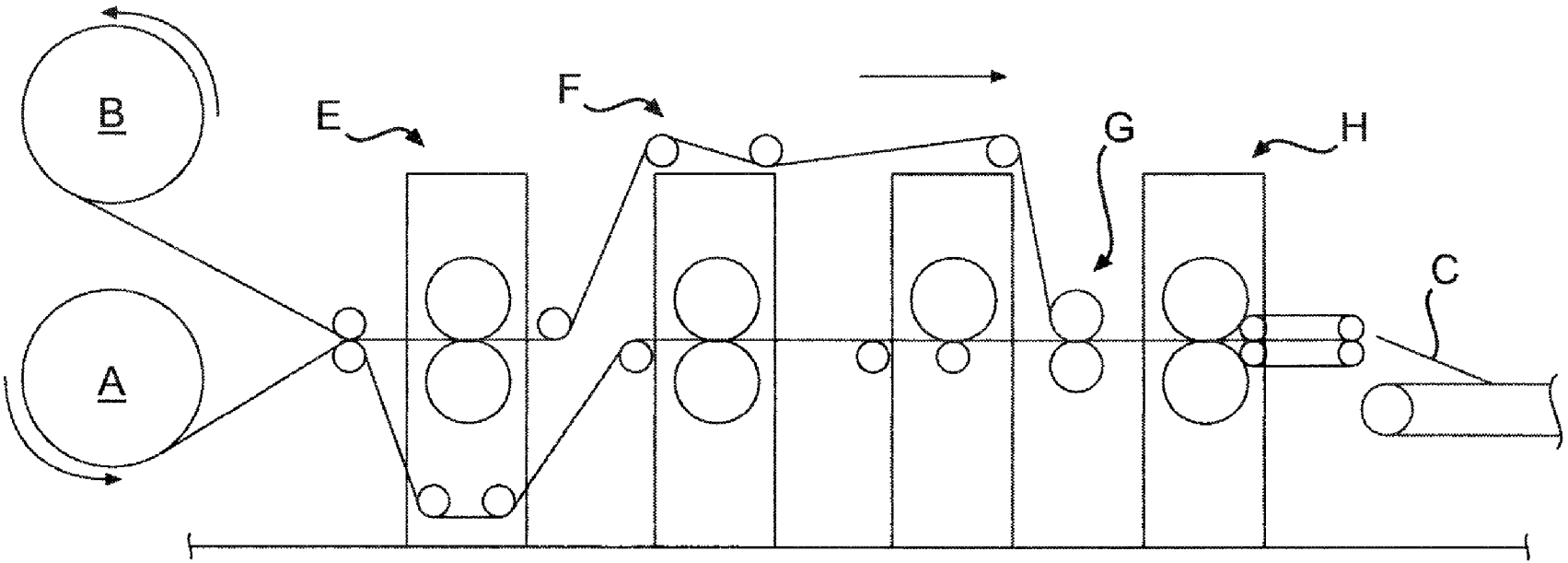
FIG. 1 is a schematic illustration of a continuous process production line.

FIG. 1 is a schematic illustration of a continuous process production line suitable for producing blanks according to the embodiments disclosed in this specification. In FIG. 1, a web of material B is repeatedly provided with one or more lines of disruption at a first disrupting station E, and a web of material A is repeatedly provided with one or more lines of disruption at a second disrupting station F. The webs of material A, B may then be laminated together at a lamination station G, and passed through a third disrupting station H. The laminated webs may be separated into individual two-ply carton blanks C at the third disrupting station H, and also, if desired, provided with additional lines of disruption. The combined webs are generally separated into the individual blanks C at the points between the repeating patterns of lines of disruption.

In general, each of the cartons discussed herein can be formed from exterior (or outer) and interior (or inner) webs, which are indicated by reference signs A and B in FIG. 1, respectively. The terms "inner" and "outer" are used in this specification to indicate the location of the respective webs (and corresponding blank plys) in a product, such as a carton, formed or erected from the finished multi-ply blanks C. The outer and inner webs A and B may each be individually provided with one or more lines of disruption prior to laminating the webs together. Unless specifically stated otherwise, the plan views of final blanks of this specification illustrate blanks having significant portions with at least two plys (i.e., "multi-ply") formed from individual webs A and B, such as the two-ply blank C shown in FIG. 1.

For purposes of the description presented herein, the term "line of disruption" can be used to generally refer to a cut line, a score line, a tear line, a crease line, perforations, a fold line, or other disruptions formed in a blank (or a combination of at least one cut line, score line, tear line, crease line, and/or fold line, or other disruptions). A "breachable" line of disruption as disclosed in the specification refers to a line of disruption that is intended to be breached or otherwise torn during ordinary use of a carton.

Figure 2:
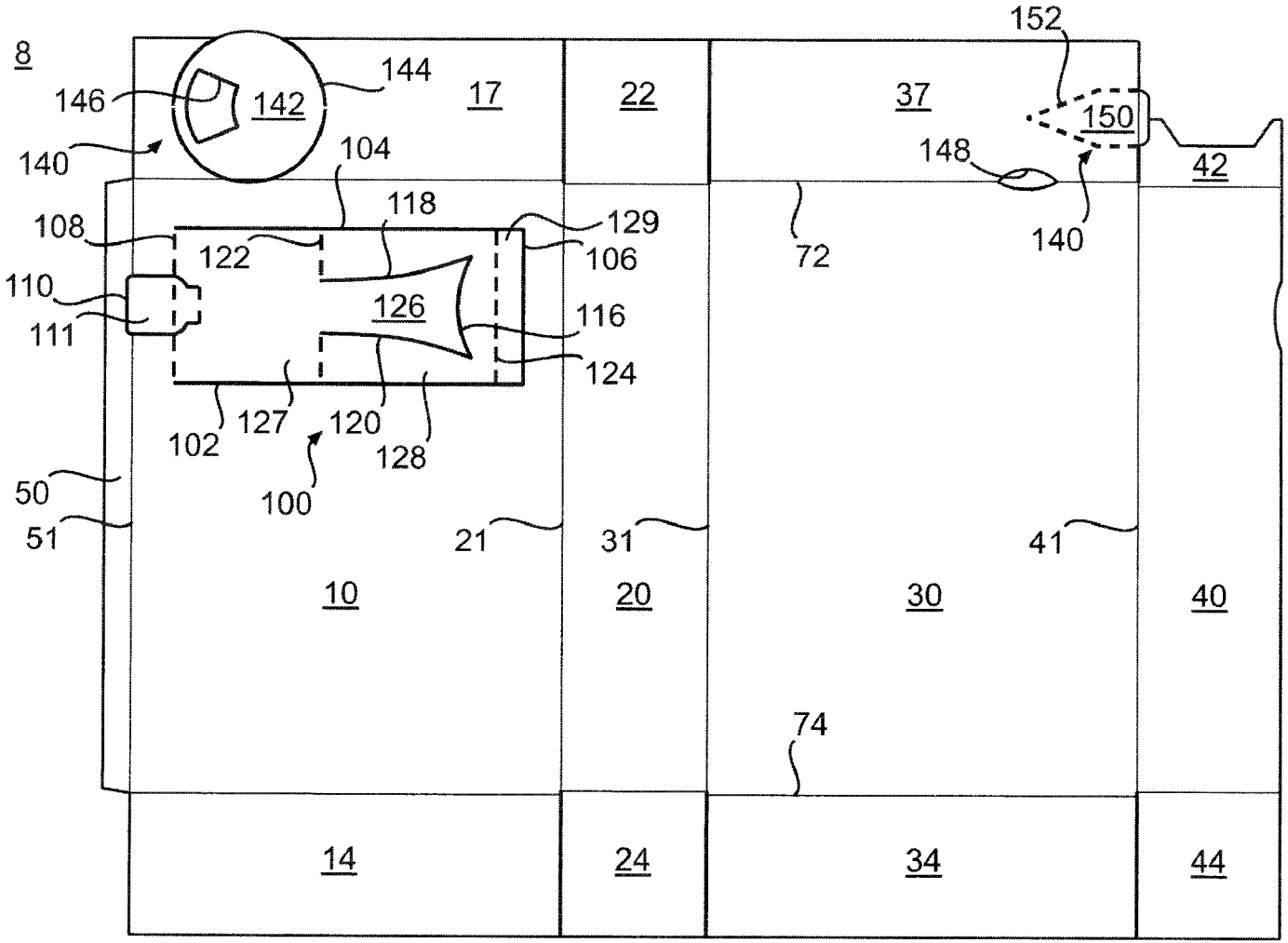
FIG. 2 is a plan view of a blank used to form a carton according to a first embodiment of the invention.

FIG. 2 is a plan view of a final multi-ply blank 8 used to form a carton 190 (illustrated in FIG. 5) according to a first embodiment of the invention. The blank 8 is formed from an outer blank 5 and an inner blank 6 adhered, laminated or otherwise joined to the outer blank 5. The outer blank 5 and the inner blank 6 are illustrated separately in FIGS. 3 and 4, respectively. The outer surface or print surface of the outer blank 5 is visible in FIG. 2, and the inner blank 6 is joined to the opposite, interior or underside of the outer blank 5. Therefore, the inner blank 6 is not visible in FIG. 2. The final blank 8 is "multi-ply" in that the inner and outer blank plys 5 and 6 comprising the blank 8 include substantial overlapping portions.

The terms "two-ply" and "multi-ply" do not indicate that all sections of the blank 8 are formed from two or more plys. For example, the blanks 5 and 6 may have slightly different perimeters or "footprints" and may not overlap at all points. In general, the outer blank 5 may be formed from a continuous web such as the web A shown in FIG. 1, and the inner blank 6 may be formed from a separate, continuous web B. The separate webs A and B may undergo processing in the production line of FIG. 1, for example, including lamination together at station G, and separation into a final two-ply blank 8 at the third disrupting station H.

Referring to FIG. 2, the blank 8 comprises a first side panel 10 foldably connected to a first end panel 20 at a first transverse fold line 21, a second side panel 30 foldably connected to the first end panel 20 at a second transverse fold line 31, and a second end panel 40 foldably connected to the second side panel 30 at a third transverse fold line 41. An adhesive flap 50 can be foldably connected to the first side panel 10 at a fourth transverse fold line 51. The transverse fold lines 21, 31, 41 can be formed by, for example, cuts or scores extending through both the inner and outer blanks 6, 5.

The first side panel 10 is foldably connected to a first side top flap 17 of the outer blank 5 and a first side top flap 18 of the inner blank 6, and a bottom first side flap 14. The first end panel 20 is foldably connected to first end top flap 22 and a first end bottom flap 24. The second side panel 30 is foldably connected to a second side top flap 37 or the first outer blank 5 and a second side top flap 38 of the inner blank 6, and a second side bottom flap 34. The second end panel 40 is foldably connected to a second end top flap 42 and a second end bottom flap 44. The top end flaps extend along a first or top marginal area of the blank 8, and may be foldably connected at the first longitudinal fold line 72 that extends along the length of the blank 8. The bottom end flaps extend along a second or bottom marginal area of the blank 8, and may be foldably connected at the second longitudinal fold line 74 that also extends along the length of the blank 8. The longitudinal fold lines 72, 74 may be substantially straight fold lines, or may be offset at one or more locations to account for, for example, blank thickness or other factors.

Figure 4:
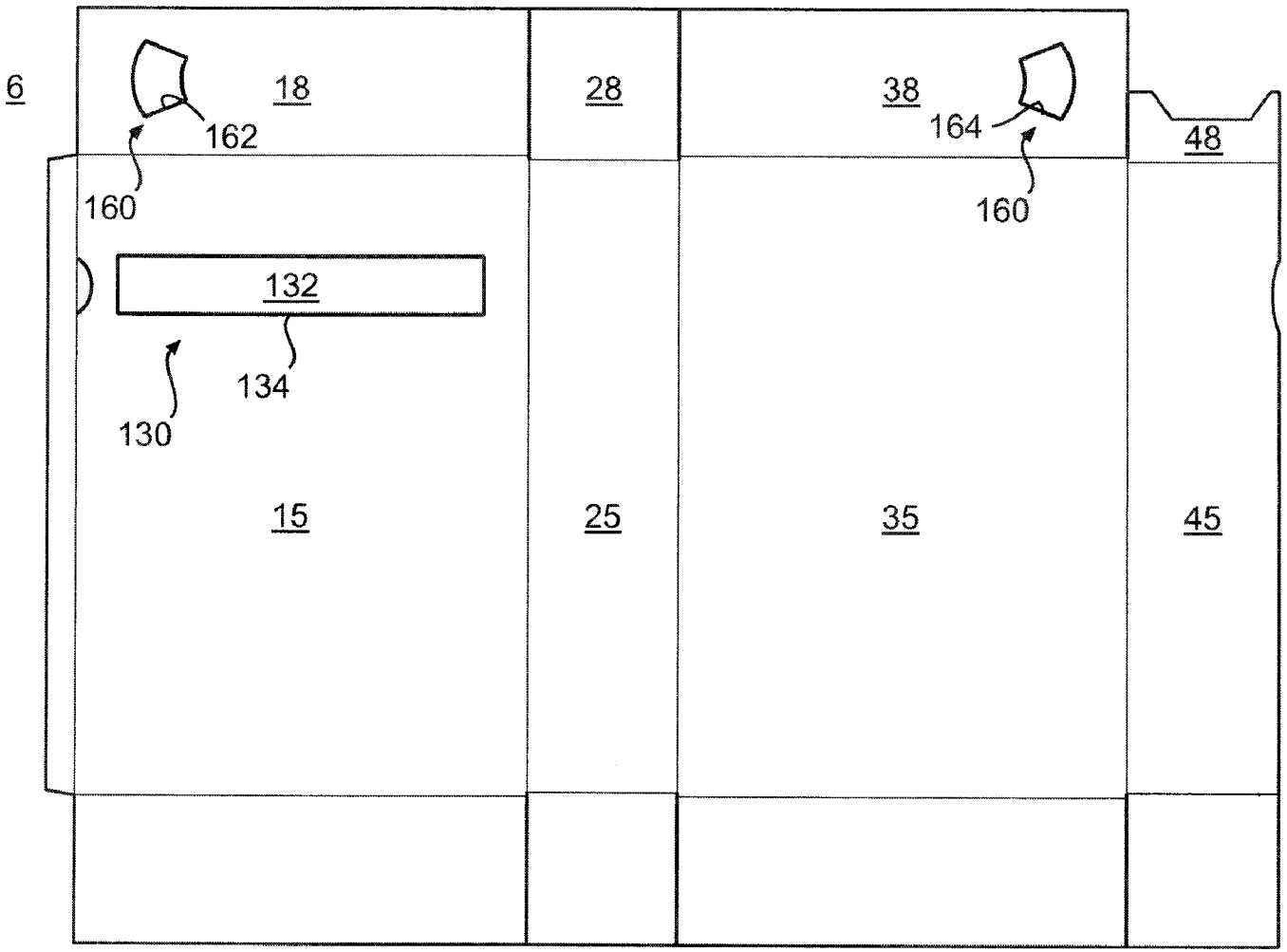
FIG. 4 is a plan view of an interior ply of the blank of FIG. 2.
Figure 5:
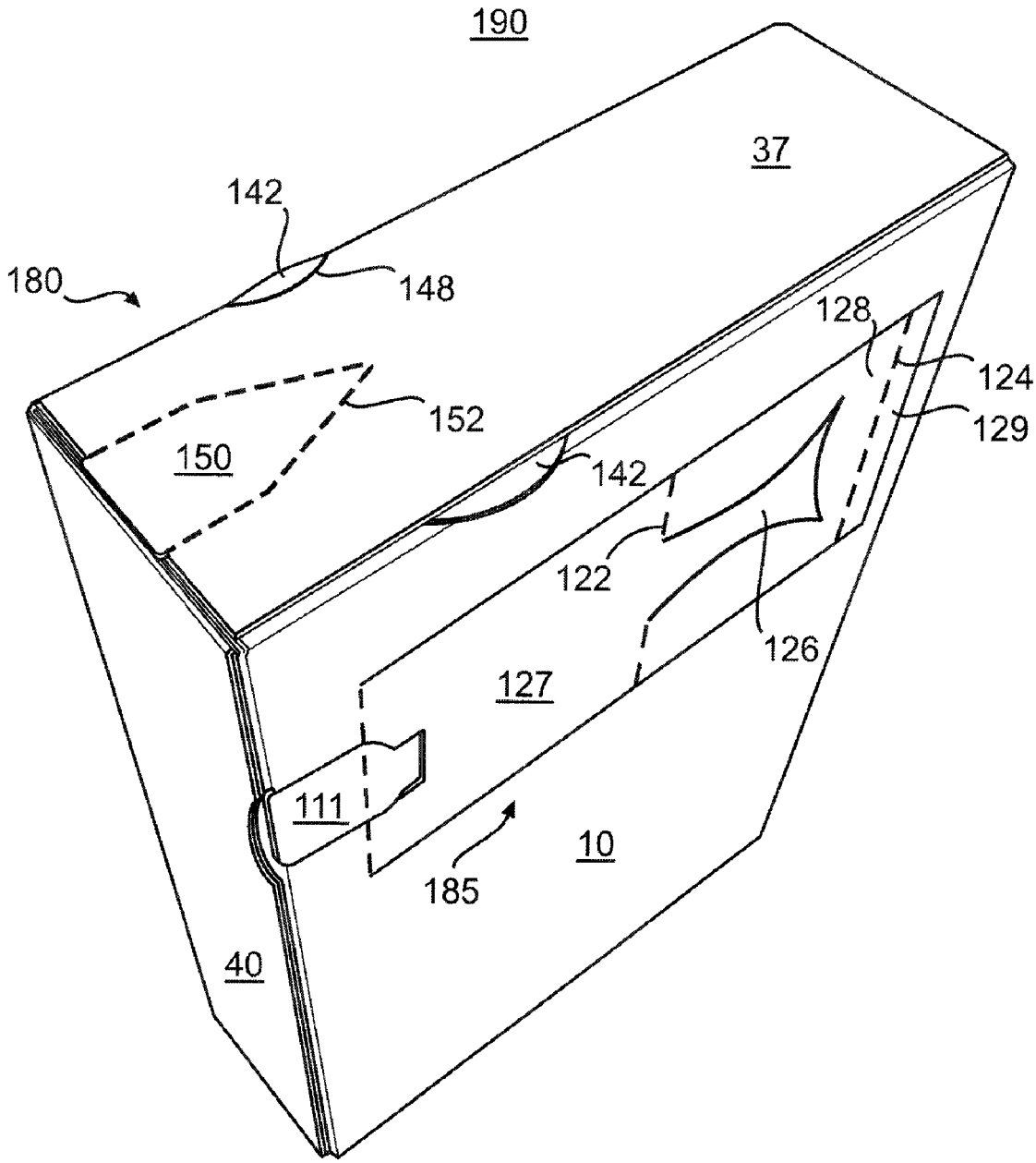
FIG. 5 illustrates the first carton embodiment.

The blank 8 includes an outer display pattern 100 that in part defines a display feature 185 in the carton 190 (illustrated in FIG. 5). The outer display pattern 100 is formed in the outer blank 5 and generally does not extend into the inner blank 6. The lines of disruption forming the outer display pattern 100 can be formed in the outer web A, for example, before lamination to the inner web B. The outer display pattern 100 includes spaced lines of disruption such as cuts 102, 104 that extend across the first side panel 10 and define upper and lower edges of the display feature 185. A cut 106 extends through the panel 10 and may connect the lines 102, 104. A fold line, such as a cut-space line 108 extends through the panel 10 adjacent to the fold line 51. A pull tab 111 is defined by a perimeter cut 110. Curved cuts 116, 118, 120 define an extension panel 126 in the pattern 100. A fold line, such as a cut-space line 122, foldably connects first and second pivot panels 127, 128. A fold line, such as a cut-space line 124, in part defines an adhesive panel 129 adjacent to the panel 128. The outer display pattern 100 interacts with an inner display pattern 130 formed in the inner blank 6, as discussed in detail below with reference to FIG. 4.

The blank 8 also includes an outer dispenser pattern 140 that in part defines a dispenser 180 in the carton 190 (illustrated in FIG. 5). The outer dispenser pattern 140 is formed in the outer blank 5 and generally does not extend into the inner blank 6. The lines of disruption forming the outer dispenser pattern 140 can be formed in the outer web A, for example, before lamination to the inner web B. The outer dispenser pattern 140 includes a perimeter line of disruption 144 that defines a rotatable dispenser panel 142, and a cutout aperture 146 in the dispenser panel 142. The perimeter line 144 can be a breachable line of disruption or a cut, for example. The cutout 146 could also be breachable line defining a knockout section, for example, that could be removed before use of the dispenser 180. A clearance cutout 148 is formed along the fold line 72. The outer dispenser pattern 140 also includes a removable cover panel 150 defined by a breachable perimeter line of disruption 152. The outer dispenser pattern 140 interacts with an inner dispenser pattern 160 formed in the inner blank 6, as discussed in detail below with reference to FIG. 4.

Figure 3:
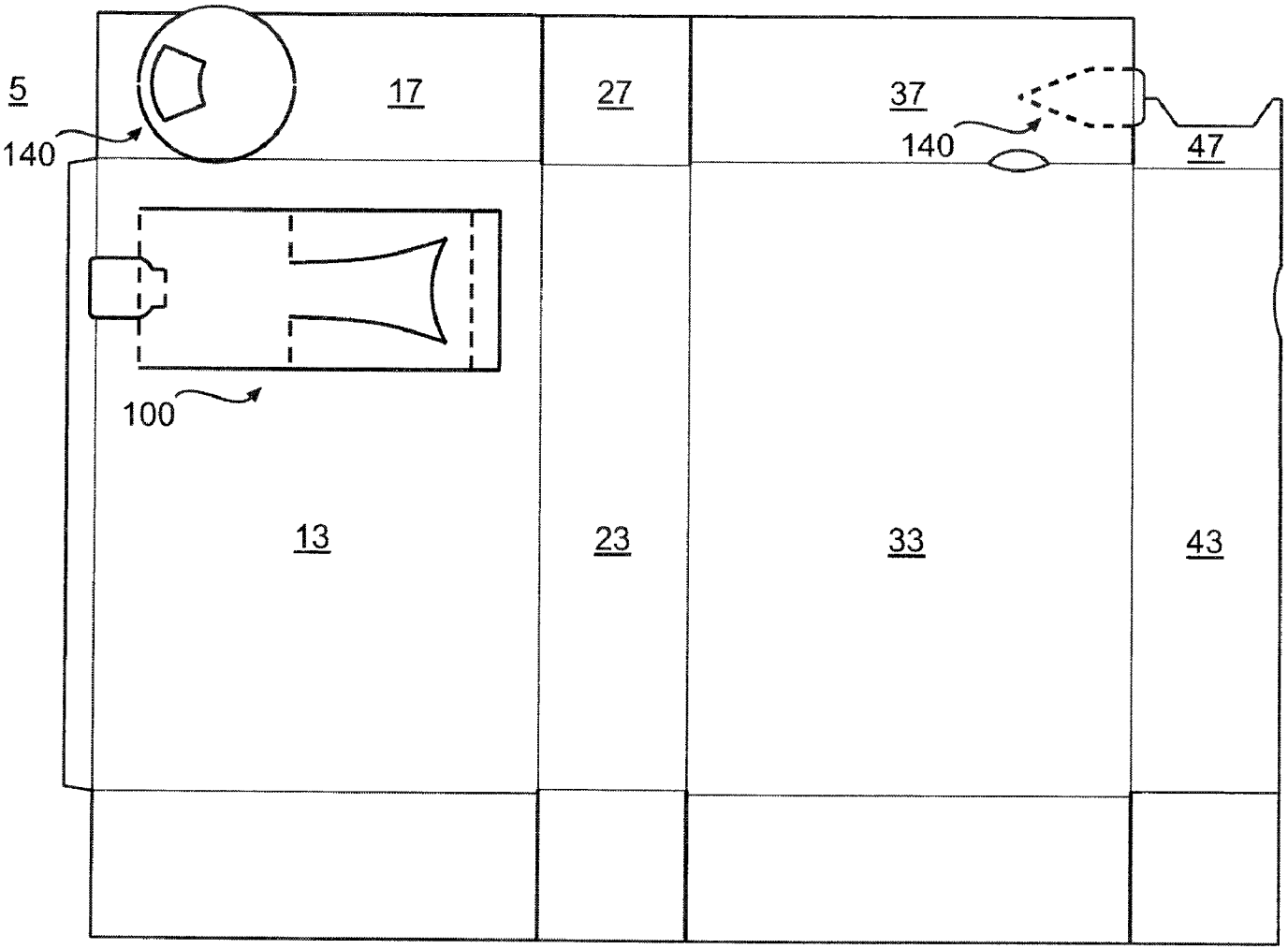
FIG. 3 is a plan view of an exterior ply of the blank of FIG. 2.

FIG. 3 is a plan view of the outer ply or blank 5 of the blank 8. A continuous series of outer blanks 5 may be formed from the web A in the production line illustrated in FIG. 1. Repeating patterns of lines of disruption in the web A may be formed, for example, at the disrupting station F shown in FIG. 1. At the end of the production line, each outer blank 5 is joined to a corresponding inner blank 6 to form the blanks 8. Any combination of the lines of disruption formed in the web A may be formed at the disrupting station F. For example, the outer display pattern 100 or outer dispenser pattern 140 may be formed at station F. The outer blank 5 includes panels 13, 23, 33, 43 that form the outer plys of the two-ply panels 10, 20, 30, 40.

FIG. 4 is a plan view of the inner ply or blank 6 of the blank 8. A continuous series of inner blanks 6 may be formed from the web B in the production line illustrated in FIG. 1. Repeating patterns of lines of disruption formed in the web B may take place, for example, at the disrupting station E shown in FIG. 1.

The inner blank 6 includes panels 15, 25, 35, 45 that form the inner plys of the two-ply panels 10, 20, 30, 40. The inner blank 6 includes an inner display pattern 130 that in part defines the display feature 185 in the carton 190 (illustrated in FIG. 5). The inner display pattern 130 is formed in the inner blank 6 and the lines of disruption forming the display pattern 130 can be formed in the inner web B, for example, before lamination to the outer web A. The inner display pattern 130 may include a breachable perimeter line or cut 134 defining a slider panel 132 in the panel 15. An inner dispenser pattern 160 is also formed in the inner blank 6. The inner dispenser pattern 160 comprises first and second dispenser apertures 162, 164. The dispenser apertures 162, 164 could also be knockout sections defined by breachable perimeter lines.

Any of the cuts described above can be substituted with breachable lines of disruption, such as tear lines, for example.

The exterior side of the inner blank 6 can be joined to the interior side of the outer blank 5 across essentially the entire overlapping surface area of the blanks 5, 6, except at the panels 126, 127, 128 in the outer blank 5. The adhesive panel 129 is adhered to the slider panel 132, and the base of the tab 111 also adhered to the slider panel 132. The dispenser panel 142 and the cover panel 150 should not be adhered to the inner blank 6. The end flaps 17, 18 are not adhered together, and the end flaps 37, 38 are not adhered together. The end flaps 27, 28 may be adhered together to form the end flap 22, and the end flaps 47, 48 may be adhered together to form the end flap 42.

Any combination of the lines of disruption formed in the web B may be formed at the disrupting station E. For example, the inner display pattern 130, and the inner dispenser pattern 160 can be formed at station E. Final processing of the webs, including separation of the combined webs A and B into blanks 8, occurs at station H. The transverse fold lines 21, 31, 41, 51 can be formed simultaneously in the inner and outer blanks 5, 6 at station H.

The carton may be erected by adhering the exterior of the adhesive flap 50 to the interior side of the panel 40. The blank 8 can now be opened up into a generally tubular form. The bottom end of the tubular blank form may closed by folding the end flaps 24, 44 inwardly, folding the flap 14 over the flaps 24, 44, and then folding the flap 34 over the flap 14. The two-ply bottom end flaps 14, 24, 34, 44 can be adhered together by adhesives such as, for example, glue.

The two-ply top flaps 22, 42, which can comprise, top flaps 27, 28 adhered together and top flaps 47, 48 adhered together, respectively, are folded inwardly. Next, the flap 38 is folded over the flaps 22, 42. The flap 18 is then folded over the flap 38 and adhered thereto. The flap 17 is then folded over the flap 18 and adhered thereto at locations outside of the panel 142. The flap 37 is then folded over the flap 17 and adhered to the flap 17 at locations outside of the panel 142.

FIG. 5 illustrates the erected carton 190 with its top and bottom ends closed. Product, such as particulate matter, discrete articles, or other items, such as pouches, may be loaded into the carton 190 at any time before closing the top and bottom ends of the carton.

Figure 6:
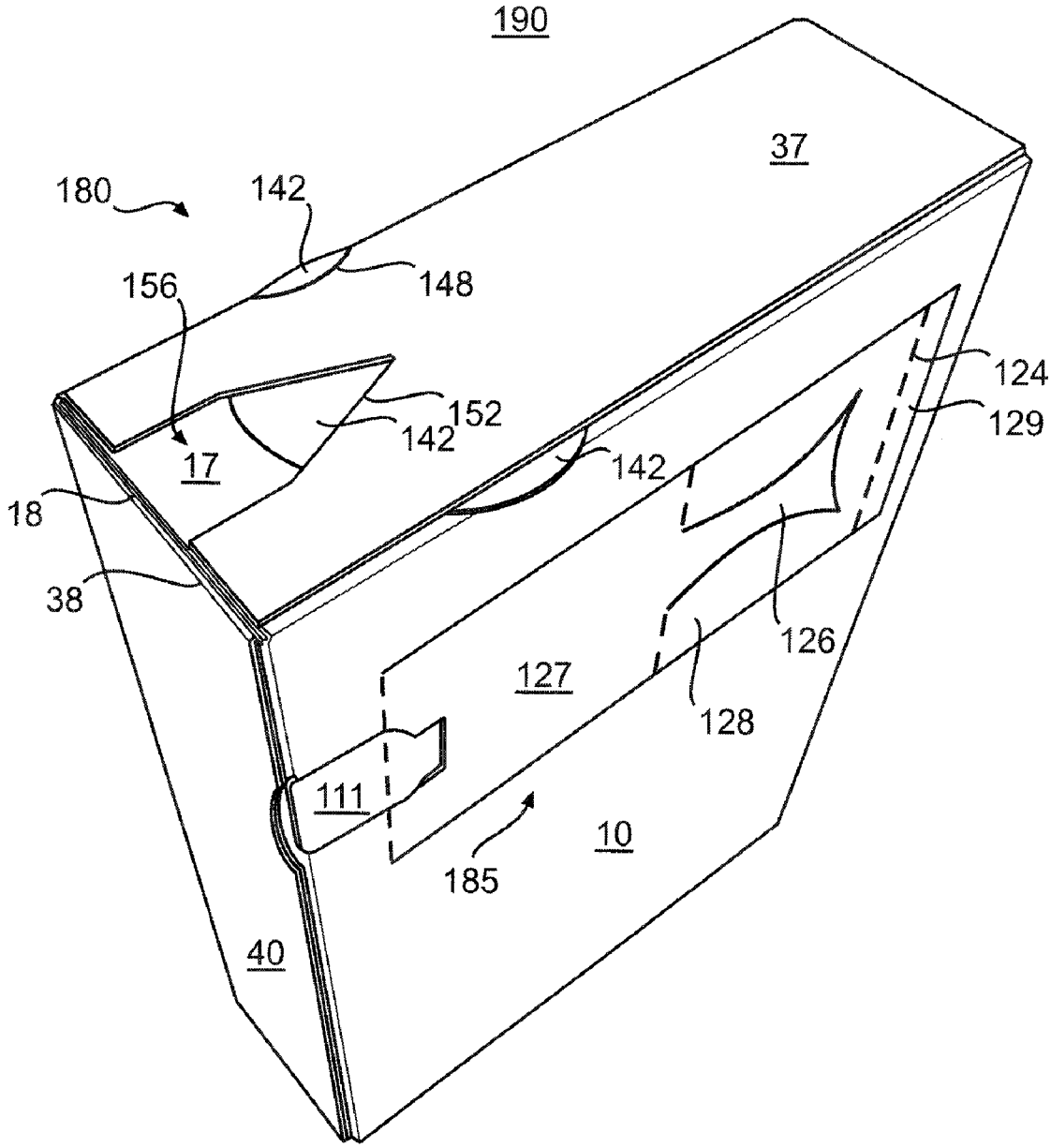
FIGS. 6 and 7 illustrate operation of a dispenser feature of the carton.
Figure 7:
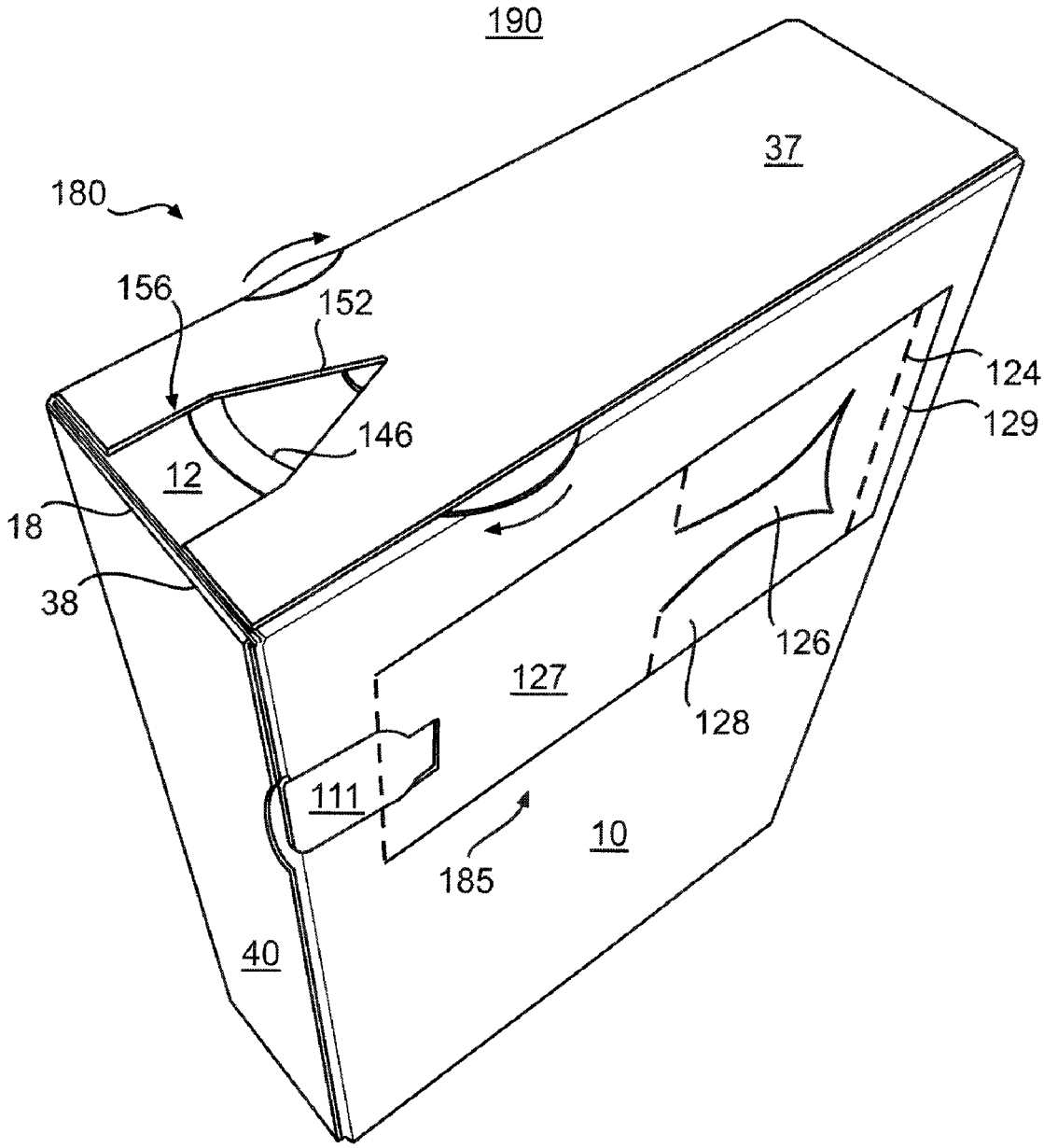

FIGS. 6 and 7 illustrate operation of the dispenser feature 180. Referring to FIG. 6, the cover panel 150 may be removed at the perimeter line of disruption 152, leaving a dispenser opening 156 in the panel 37. The dispenser panel 142 may be rotated between the panels 37 and 18. In FIG. 6, the panel 142 is in a closed position. In FIG. 7, the dispenser panel 142 is rotated to a dispensing position, where the aperture 146 is aligned with the opening 156. Product can be dispensed from the carton 190 when the dispensing feature 180 is in the dispensing configuration of FIG. 7.

Figure 8:
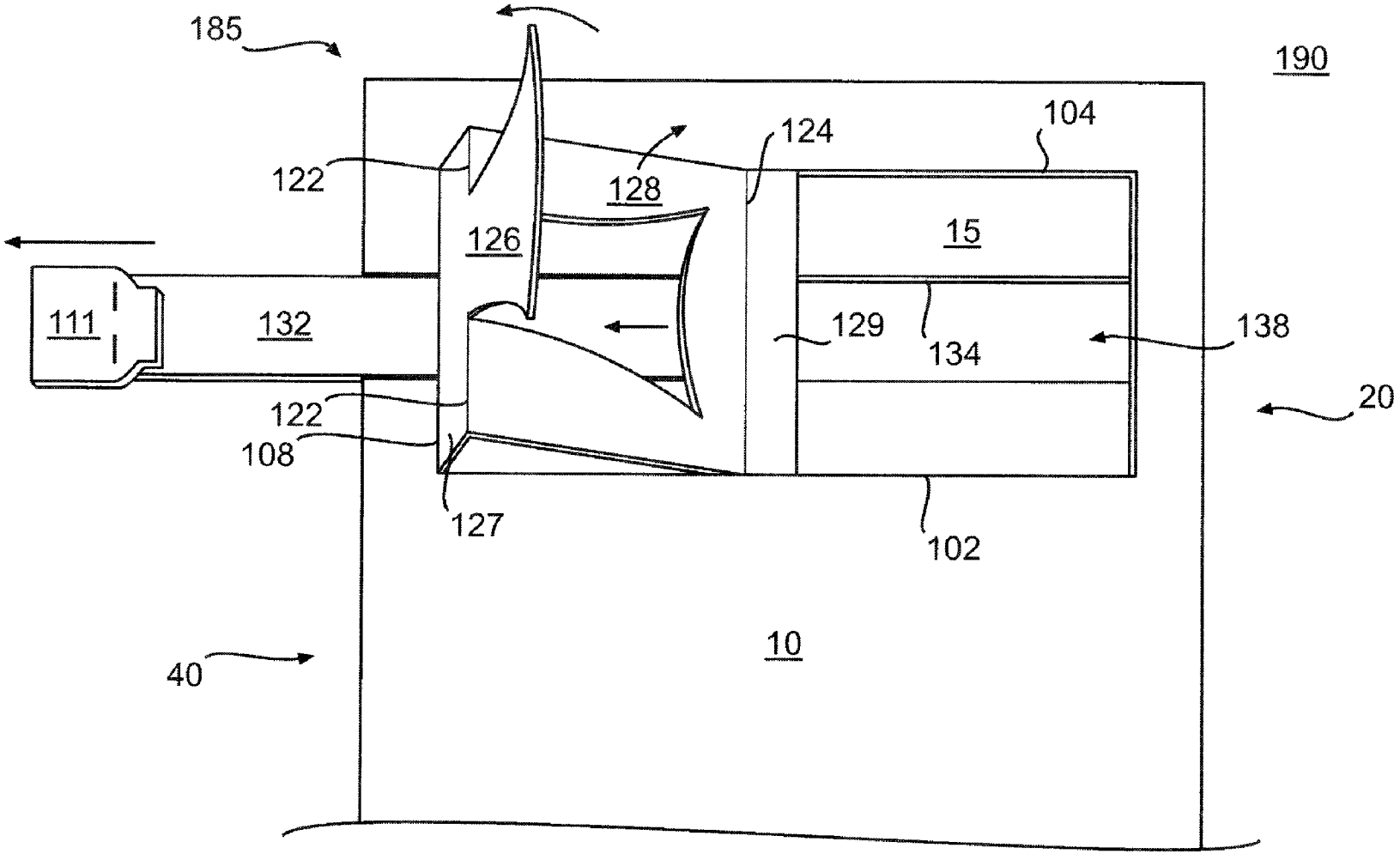
FIG. 8 illustrates operation of a display feature of the carton.

FIG. 8 illustrates operation of the display feature 185. The display feature 185 is actuated by pulling on the pull tab 111. The slider panel 132 is adhered to the pull tab 111, and in turn causes the adhesive panel 129 to move the left in FIG. 8. The adhesive panel 129 is foldably connected to the second pivot panel 128, and the second pivot panel 128 moves the left and pivots upwardly about the fold line 124. The first pivot panel 127 is foldably connected to the second pivot panel 128 at the fold lines 122, and moves to the left and pivots also about the fold line 108. This movement causes the extension panel 126 to extend to a highly visible position away from the panel 10. A side panel opening 138 is left as the slider panel 132 moves to the left.

In accordance with the exemplary embodiments, the cartons may be constructed of paperboard, for example. The paperboard webs used to form the blank may be thicker and heavier than ordinary paper. The blanks, and thus the cartons, can also be constructed of other materials, such as cardboard, or any other material having properties suitable for enabling the carton to function at least generally as described above. For example, the blanks may be formed from coated solid unbleached sulfate (SUS) board. The blanks can also be laminated to or coated with one or more web-like materials at selected panels or panel sections.

One or more panels of the blanks discussed above can be coated with varnish, clay, or other materials, either alone or in combination. The coating may then be printed over with product, advertising, and other information or images. The blanks may also be coated to protect any information printed on the blank. The blanks may be coated with, for example, a moisture barrier layer, on either or both sides of the blanks.

In accordance with the exemplary embodiments, a fold line can be any substantially linear, although not necessarily straight, form of weakening that facilitates folding thereal-ong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or panels adhered together by glue. The term "glue" is intended to encompass all manner of adhesives commonly used to secure carton panels in place.

The term "line" as used herein includes not only straight lines, but also other types of lines such as curved, curvilinear or angularly displaced lines.

In the present specification, a "panel" need not be flat or otherwise planar. A "panel" can, for example, comprise a plurality of interconnected generally flat or planar sections.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton formed at least from an inner blank and an outer blank, comprising:

a multi-ply first side panel formed at least from the inner blank and the outer blank;

a first end panel;

a second side panel;

a second end panel, wherein a display feature is formed in the first side panel, the display feature comprising:

an extension panel formed from the outer blank that can be selectively moved away from the first side panel;

a first pivot panel and a second pivot panel foldably connected to the first pivot panel, the first and second pivot panels being formed from the outer blank;

a slider panel formed in the first side panel and slidably mounted within the carton, the slider panel being operably connected to the first pivot panel and the second pivot panel to cause folding of the first pivot panel and the second pivot panel, an adhesive panel adhered to the slider panel and foldably connected to the second pivot panel, the adhesive panel being formed from the outer blank, and cuts in the first side panel that respectively define an upper edge and a lower edge of the display feature, the adhesive panel is in slideable engagement with the upper edge and the lower edge of the display feature to activate the dispenser feature.

2. The carton of claim 1 further comprising:

a bottom panel; and a multi-ply top panel opposite from the bottom panel and generally perpendicular to the first and second end panels, the multi-ply top panel having a rotatable dispenser panel, and the rotatable dispenser panel being adapted for being rotated about an axis of rotation to allow the carton to be changed from a closed configuration to a dispensing configuration, wherein the axis of rotation extends through a central portion of the dispenser panel in an axial direction that is generally perpendicular to the top panel, the bottom panel and the multi-ply top panel are spaced apart from one another in the axial direction, and the rotatable dispenser panel comprises a dispenser aperture, the dispenser panel is rotatably mounted between two overlapped side top flaps, and when the dispenser panel is rotated about the axis of rotation relative to the overlapped side top flaps, the dispenser panel remains in generally parallel planar relationship with the multi-ply top panel.

3. The carton of claim 2, wherein each of the side top flaps includes a dispenser aperture that is aligned with the dispenser aperture in the dispenser panel when the carton is in the dispensing configuration.

4. The carton of claim 2, wherein the rotatable dispenser panel is formed from a side top flap of the outer blank.

5. The carton of claim 2, wherein:

the multi-ply top panel further comprises at least two end top flaps; and the first side panel, the first end panel, and the second end panel are multi-ply.

6. The carton of claim 2, wherein the multi-ply top panel further comprises a removable cover panel defined at least in part by a breachable perimeter line of disruption.

7. The carton of claim 6, wherein:

the removable cover panel is defined in a second side top flap connected to the second side panel; and the rotatable dispenser panel is formed from a first side top flap connected to the first side panel.

8. The carton of claim 2, wherein the multi-ply top panel further comprises at least two end top flaps.

9. The carton of claim 2, wherein the first side panel, the first end panel, and the second end panel are multi-ply.

10. The carton of claim 2, comprising inner dispenser apertures in the inner blank, wherein:

the rotatable dispenser panel is formed by the outer blank;

the outer dispenser aperture is not aligned with the inner dispenser apertures when the carton is in the closed configuration; and the outer dispenser aperture is aligned with the inner dispenser apertures when the dispenser panel is rotated to position the carton in the dispensing configuration.

11. The carton according to claim 2, wherein the rotatable dispenser panel is circular.

12. The carton according to claim 11, wherein the axis of rotation extends through the center of the rotatable dispenser panel.

13. The carton according to claim 2, wherein the dispenser panel rotates about the axis of rotation in a manner that prevents translational movement of the dispenser panel relative to the multi-ply top panel.

14. The carton of claim 1, wherein the extension panel extends from the first pivot panel, the first pivot panel being generally perpendicular to the first side panel.

15. The carton according to claim 1, wherein the first pivot panel and the second pivot panel are pivoted by the sliding translational movement of the adhesive panel that is in slideable engagement with the upper edge and the lower edge of the display feature.

* * * * *